US010974371B2

(12) United States Patent
Chang

(10) Patent No.: US 10,974,371 B2
(45) Date of Patent: Apr. 13, 2021

(54) HAND TOOL

(71) Applicant: Tsung-Chih Chang, Taichung (TW)

(72) Inventor: Tsung-Chih Chang, Taichung (TW)

( * ) Notice: Subject to any disclaimer, the term of this patent is extended or adjusted under 35 U.S.C. 154(b) by 281 days.

(21) Appl. No.: 16/253,828

(22) Filed: Jan. 22, 2019

(65) Prior Publication Data

US 2019/0152028 A1 May 23, 2019

Related U.S. Application Data

(63) Continuation-in-part of application No. 15/069,342, filed on Mar. 14, 2016, now abandoned.

(51) Int. Cl.
*B25B 17/02* (2006.01)
*B25B 15/02* (2006.01)
*B25B 33/00* (2006.01)

(52) U.S. Cl.
CPC ..... *B25B 17/02* (2013.01); *B25B 15/02* (2013.01); *B25B 33/00* (2013.01)

(58) Field of Classification Search
CPC ..... B25B 17/00; B25B 15/00; B25B 15/02; B25B 17/02; B25B 13/48; B25B 13/461; B25B 13/467; B25B 13/481; B25B 21/00; B25B 33/00
See application file for complete search history.

(56) References Cited

U.S. PATENT DOCUMENTS 2,339,531 A * 1/1944 Sittert ..... B25B 21/026 173/93.6
2,780,944 A 2/1957 Ondeck
3,067,847 A * 12/1962 Beach ..... B63H 25/10 192/215
3,783,491 A 1/1974 Meitz
3,992,964 A * 11/1976 Osmond ..... B25B 17/02 81/57.31
4,162,639 A 7/1979 Gill
4,346,624 A * 8/1982 Nagasaki ..... F16F 15/315 475/159

* cited by examiner

*Primary Examiner* — Robert J Scruggs
(74) *Attorney, Agent, or Firm* — Muncy, Geissler, Olds & Lowe, P.C.

(57) ABSTRACT

A hand tool includes a housing defining a receiving space, a shaft rotatably extending through the receiving space and having opposite end portions that are exposed from the housing, a ring-shaped flywheel disposed rotatably in the receiving space and surrounding the shaft, and a speed-increasing gear mechanism. The gear mechanism includes a start gear coupled co-rotatably to the shaft and disposed in the receiving space, at least one transmission gear rotatably disposed in the receiving space and meshing with the start gear, and a final gear coupled co-rotatably to the flywheel, disposed in the receiving space and meshing with the transmission gear. A rotational speed of the final gear is greater than that of the start gear.

16 Claims, 6 Drawing Sheets

HAND TOOL

The present invention is a CIP of application Ser. No. 15/069,342, filed Mar. 14, 2016, the entire contents of which are hereby incorporated by reference.

BACKGROUND OF THE INVENTION

Field of the Invention

Description of the Prior Art

Referring to FIG. 1, a conventional hand tool includes a T-shaped main body 2 and a sleeve handle 1. The main body 2 has a handle portion 201, and an operating portion 202 perpendicular to the handle portion 201 and sleeved by the sleeve handle 1. The main body 2 is rotatable relative to the sleeve handle 1.

In an operation of the conventional hand tool, a user holds the sleeve handle 1 with one hand, and holds the handle portion 201 of the main body 2 with the other hand to turn the main body 2. When the user releases the handle portion 201, the main body 2 continues to rotate by a moment of inertia thereof, thereby efficiently fastening or unfastening a threaded fastener (not shown) via a tool head (not shown) which is coupled to the operating portion 202.

However, the handle portion 201, which is necessary for rotating and building a sufficient moment of inertia for the main body 2, renders the conventional hand tool unsuitable for operation in a limited workspace due to possible interference.

U.S. Pat. No. 3,992,964 discloses that the input drive shaft is connected to a ring gear, and the input drive shaft is fixedly attached to the ring gear by means of bolts. That is, the ring gear cannot rotate freely relative to the input drive shaft.

U.S. Pat. No. 3,992,964 discloses that a two-piece cylindrical body having a first or upper section and a second or lower section which are axially aligned with each other and connected together axially for relative rotation. That is, the first or upper section and second or lower section cannot rotate freely relative to the drive shaft at the same time.

U.S. Pat. No. 3,992,964 discloses that the rotation of the cam member will shift the clutch bars into position to engage clutch dogs, whereupon all parts will turn together. That is, all the rotatable parts cannot rotate freely relative to the central shaft at the same time.

The present invention intends to provide a hand tool to eliminate the shortcomings mentioned above.

SUMMARY OF THE INVENTION

Therefore, an object of the disclosure is to provide a hand tool that has a relatively compact structure and that can be conveniently used.

According to the disclosure, a hand tool includes a housing that defines a receiving space, a shaft that is connected to the housing and that rotatably extends through the receiving space along an axis, a ring-shaped flywheel that is disposed rotatably in the receiving space and that surrounds the shaft, and a speed-increasing gear mechanism. The shaft has a first end portion exposed from the housing, and a second end portion opposite to the first end portion along the axis and exposed from the housing. The speed-increasing gear mechanism includes a start gear, at least one transmission gear, and a final gear. The start gear is coupled concentrically and co-rotatably to the shaft, and is disposed in the receiving space between the first end portion and the second end portion of the shaft. The at least one transmission gear is rotatably connected to the housing, is disposed in the receiving space, and meshes with the start gear. The final gear is coupled co-rotatably and concentrically to the flywheel, is disposed in the receiving space, and meshes with the transmission gear. A rotational speed of the final gear is greater than that of the start gear.

The present invention will become more obvious from the following description when taken in connection with the accompanying drawings, which show, for purpose of illustrations only, the preferred embodiment(s) in accordance with the present invention.

DETAILED DESCRIPTION OF THE PREFERRED EMBODIMENTS

Figure 1:
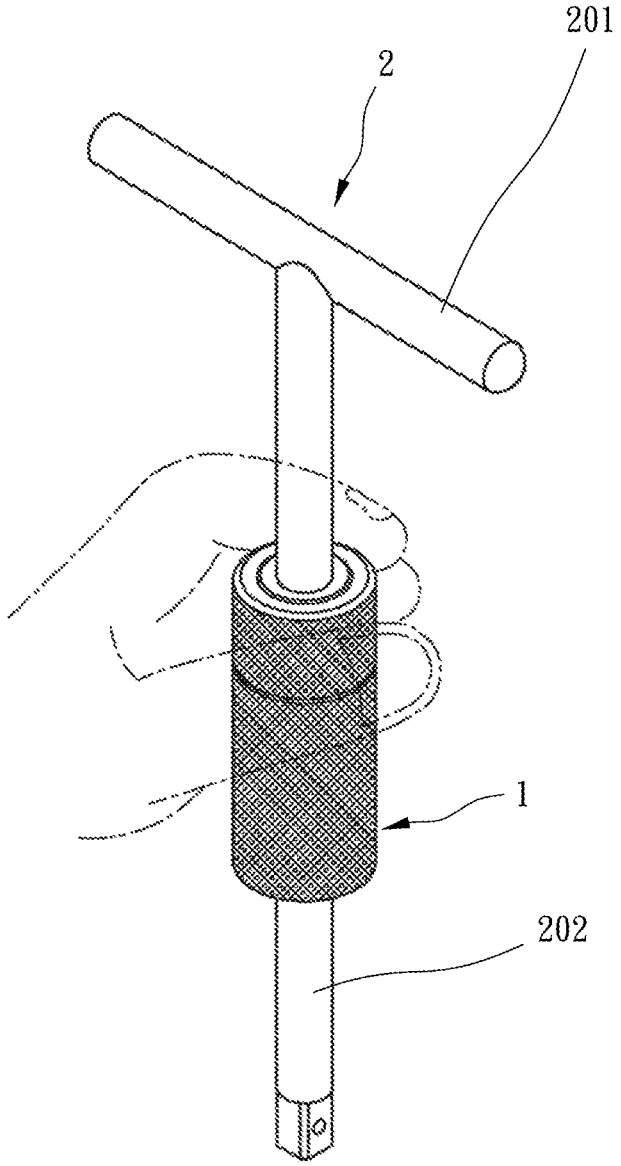
FIG. 1 PRIOR ART
FIG. 1 is a perspective view of a conventional hand tool.
Figure 2:
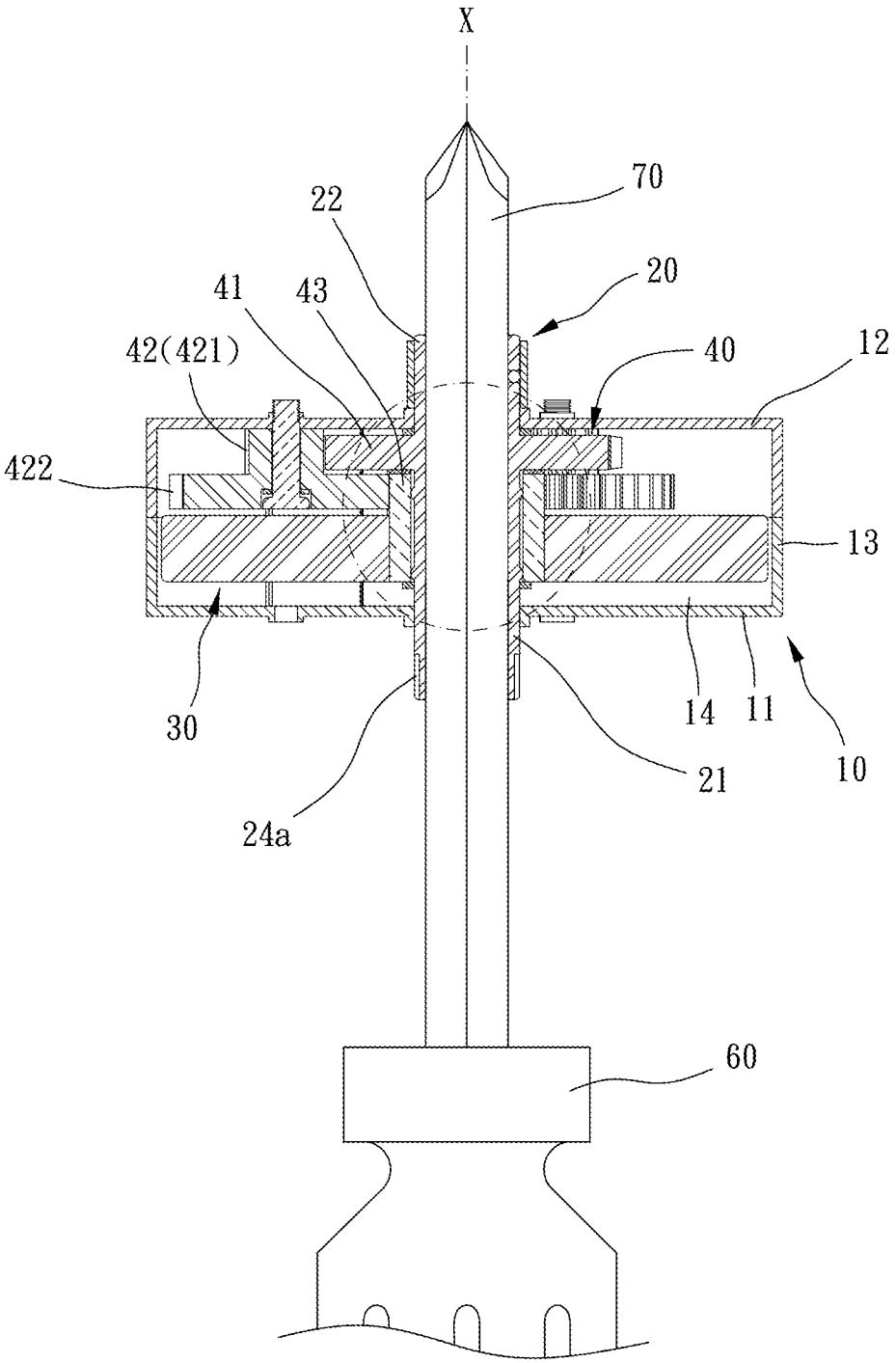
FIG. 2 is a fragmentary partly sectional view illustrating an embodiment of a hand tool according to the disclosure.
Figure 3:
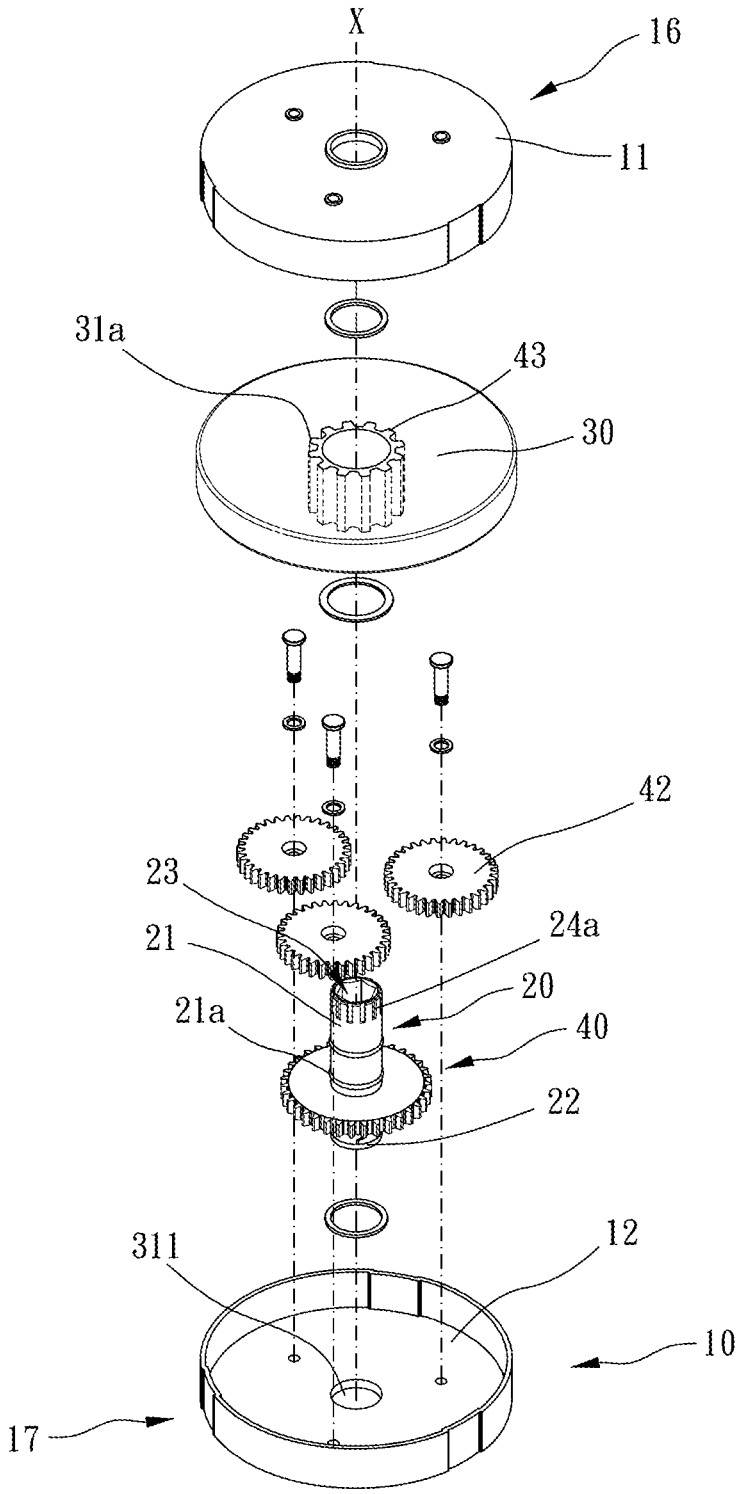
FIG. 3 is a fragmentary exploded perspective view of the embodiment.

The present invention will be clearer from the following description when viewed together with the accompanying drawings, which show, for purpose of illustrations only, the preferred embodiment in accordance with the present invention.

Referring to FIGS. 2 to 6, an embodiment of a hand tool according to the disclosure is illustrated. The hand tool includes a housing 10, a shaft 20, a ring-shaped flywheel 30, a speed-increasing gear mechanism 40, a handle 60, and a tool head 70.

The housing 10 has a first ring wall 11, a second ring wall 12 opposite to the first ring wall 11 along an axis (X), and a side wall 13 interconnecting outer peripheries of the first and second ring walls 11, 12 and cooperating with the first and second ring walls 11, 12 to define a receiving space 14.

The shaft 20 is connected to the housing 10, rotatably extends through the receiving space 14 along the axis (X), and has a first end portion 21 exposed from the housing 10, and a second end portion 22 opposite to the first end portion 21 along the axis and exposed from the housing 10. In this embodiment, the first and second ends 21, 22 of the shaft 20 are disposed respectively at opposite outer sides of the housing 10 along the axis (X).

The ring-shaped flywheel 30 is disposed rotatably in the receiving space 14, and rotatably surrounds the shaft 20. The flywheel 30 has a central hole for extension of the shaft 20 therethrough.

In this embodiment, the speed-increasing gear mechanism 40 includes a start gear 41, a plurality of transmission gears 42, and a final gear 43.

The start gear 41 is coupled concentrically and co-rotatably to the shaft 20, and is disposed in the receiving space 14 between the first end portion 21 and the second end portion 22 of the shaft 2.

The transmission gears 42 are disposed in the receiving space 14 of the housing 10, are rotatably mounted on the second ring wall 12, and mesh with the start gear 41.

The final gear 43 is coupled co-rotatably and concentrically to the flywheel 30 or can be considered as a part of the flywheel 30, is disposed in the receiving space 14 of the housing 10, is adjacent to the central hole 311, and surrounds the shaft 20.

Specifically, each of the transmission gears 42 has a first gear portion 421 that meshes with the start gear 41, and a second gear portion 422 that meshes with the final gear 43. The start gear 41 is surrounded by the first gear portions 421 of the transmission gears 42. The final gear 43 is surrounded by and meshes with the second gear portions 422 of the transmission gears 42.

In this embodiment, the first gear portion 421 of each of the transmission gears 42 possesses an outer diameter smaller than that of the start gear 41, so that a rotational speed of the transmission gears 42 is greater than that of the start gear 41. The second gear portion 422 of each of the transmission gears 42 possesses an outer diameter larger than that of the first gear portions 421, and the final gear 43 possesses an outer diameter smaller than that of the start gear 41. Therefore, a rotational speed of the final gear 43 is greater than that of the start gear 41.

In this embodiment, the handle 60 and the tool head 70 are respectively and removably connected to the first and second ends 21, 22 of the shaft 20. The tool head 70 is exemplified as a screwdriver head. It should be noted that, in other embodiments, the first and second ends 21, 22 may be respectively configured as a handle and a tool head (i.e., the shaft 20, the handle 60 and the tool head 70 may be formed as one piece).

Figure 4:
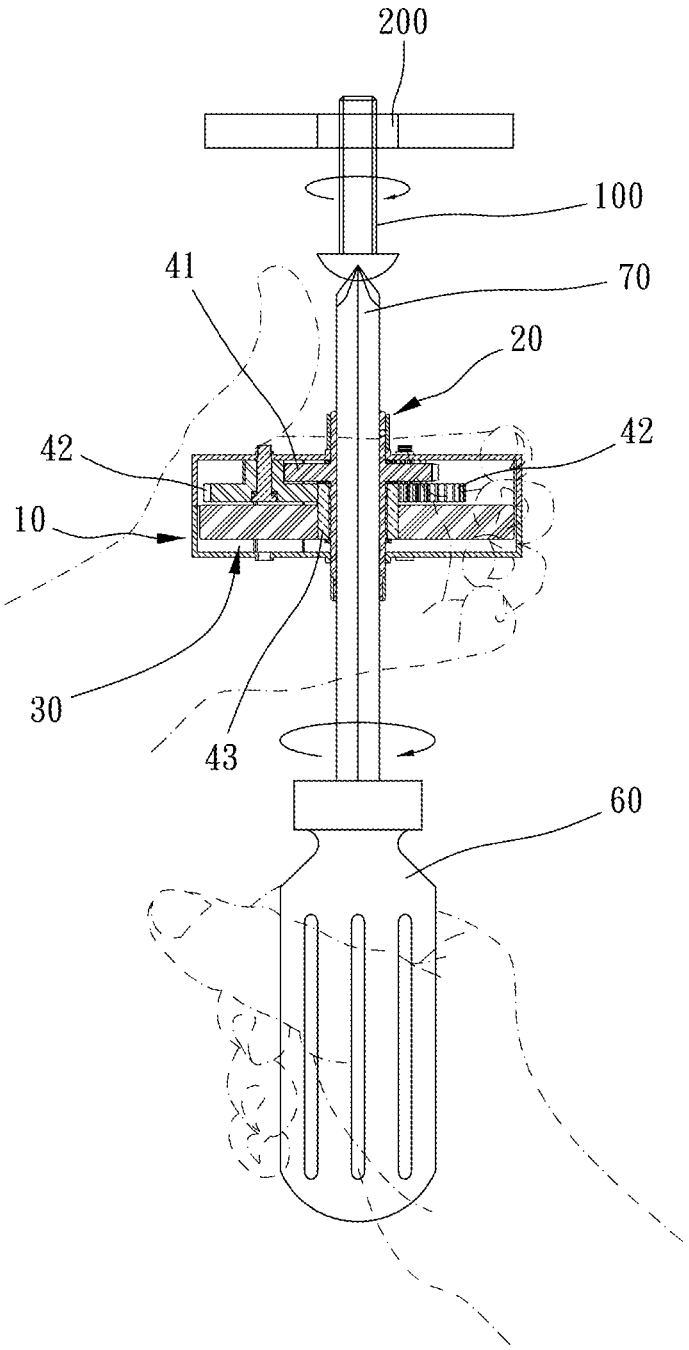
FIG. 4 is a partly sectional view illustrating a handle of the embodiment being rotated manually by a user.
Figure 5:
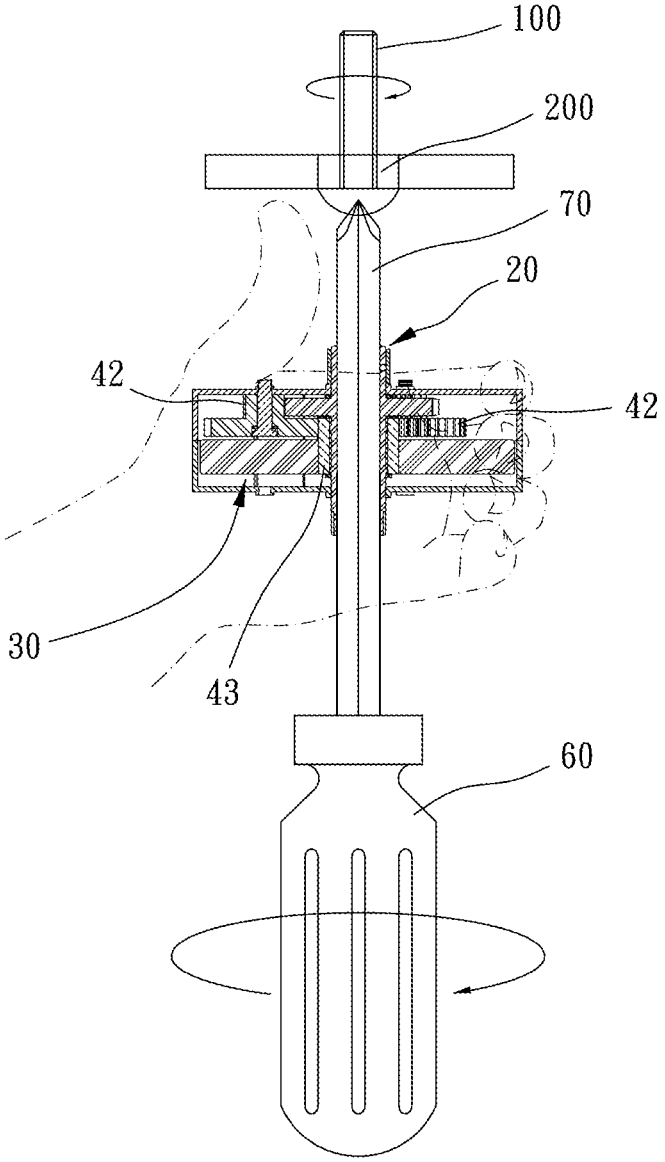
FIG. 5 is a view similar to FIG. 4, but illustrating the handle being rotated by a moment of inertia of a flywheel.
Figure 6:
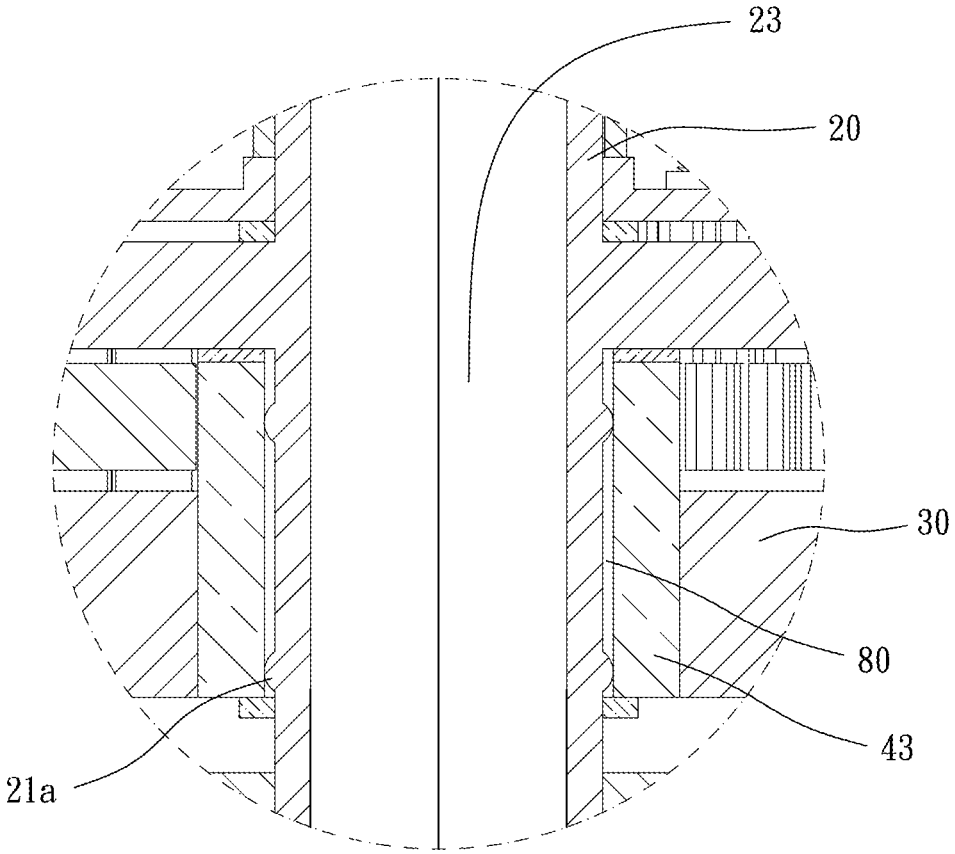
FIG. 6 is a partial enlargement of FIG. 2.

Referring to FIGS. 4 and 5, in an operation of the hand tool according to the disclosure, a user can mate the tool head 70 with a threaded fastener 100, hold the housing 10 with one hand, and turn the handle 60 with the other hand to fasten the threaded fastener 100 on a workpiece 200.

Said shaft 20 may be integrally formed of one piece or be formed by a plurality of parts, and said housing 10 has a first shell body 16 and a second shell body 17 which are fixedly connected with each other and define said receiving space 14. Said first shell body 16 has said first ring wall 11, and said second shell body 17 has said second ring wall 12.

Said first shell body 16 and said second shell body 17 are co-rotatable relative to said shaft 20 at the same time. Said ring-shaped flywheel 30 is freely rotatable relative to said shaft 20, and said ring-shaped flywheel 30 is rotatable in a rotational speed different from a rotational speed of said shaft 20. Said ring-shaped flywheel 30 is freely rotatable relative to said first shell body 16 and said second shell body 17 at the same time. As a result, said ring-shaped flywheel 30 can rotate individually and provide rotational inertia to keep driving said shaft 20 after said shaft 20 is stopped being driven by an external force.

Specifically, said ring-shaped flywheel 30 includes a toothed hole 31*a* which includes the central hole, the final gear 43 is meshed within the toothed hole 31*a* and rotatably surrounds said shaft 20, and said shaft 20 includes an axially through hole 23. Said axially through hole 23 is polygonal. For example, said axially through hole 23 is a straight hexagonal hole. Said ring-shaped flywheel 30 is preferably a solid flat ring plate. There is at least one gap 80 between said final gear 43 and said shaft 20. At least one of said final gear 43 and said shaft 20 includes at least one contact portion 21*a* radially projecting therefrom, and said at least one contact portion 21*a* spaces said final gear 43 and said shaft 20, thus reducing contact area and friction between said final gear 43 and said shaft 20. Said at least one contact portion may be integrally formed as a part of said final gear or said shaft or additionally attached to said final gear or said shaft. Said contact portion is preferably smooth annular convex.

At least one of said first end portion 21 and said second end portion 22 includes a toothed mechanism 24*a* circumferentially arranged exposed out of said housing. The toothed mechanism 24*a* is configured for engagement of another member or tool.

During rotation of the handle 60, the flywheel 30 is driven to rotate by the shaft 20 through the start gear 41, the transmission gears 42 and the final gear 43 of the speed-increasing gear mechanism 40. Then, when the user releases the handle 60 as shown in FIG. 5, the flywheel 30 continues to rotate due to its moment of inertia, thereby driving rotation of the shaft 20 and the tool head 70 via the final gear 43, the transmission gears 42 and the start gear 41 to fasten the thread fastener 100. Similarly, the user can turn the handle 60 in a reverse direction to actuate an automatic reverse rotation of the shaft 20 and the tool head 70 to unfasten the thread fastener 100.

Therefore, by virtue of the speed-increasing gear mechanism 40 and the flywheel 30, the hand tool according to the disclosure can be efficiently operated with the moment of inertia. Moreover, since the speed-increasing gear mechanism 40 increases the rotational speed of the flywheel 30, the flywheel 30 can be made compact and is consequently able to rotate without interference in a limited workspace. In addition, with the transmission gears 42 being retained in the flywheel 30, the size of the flywheel 30 can be further reduced.

In the description above, for the purposes of explanation, numerous specific details have been set forth in order to provide a thorough understanding of the embodiment(s). It will be apparent, however, to one skilled in the art, that one or more other embodiments may be practiced without some of these specific details. It should also be appreciated that reference throughout this specification to "one embodiment," "an embodiment," an embodiment with an indication of an ordinal number and so forth means that a particular feature, structure, or characteristic may be included in the practice of the disclosure. It should be further appreciated that in the description, various features are sometimes grouped together in a single embodiment, figure, or description thereof for the purpose of streamlining the disclosure and aiding in the understanding of various inventive aspects.

While the disclosure has been described in connection with what is considered the exemplary embodiment, it is understood that this disclosure is not limited to the disclosed embodiment but is intended to cover various arrangements included within the spirit and scope of the broadest interpretation so as to encompass all such modifications and equivalent arrangements.

What is claimed is:

1. A hand tool comprising:

a housing that defines a receiving space;

a shaft that is connected to said housing, that rotatably extends through said receiving space along an axis, and that has a first end portion exposed from said housing, and a second end portion opposite to said first end portion along the axis, fixedly connected with said first end portion and exposed from said housing;

a ring-shaped flywheel that is disposed in said receiving space and that rotatably surrounds said shaft; and a speed-increasing gear mechanism that includes a start gear coupled concentrically and co-rotatably to said shaft, and disposed in said receiving space between said first end portion and said second end portion of said shaft, at least one transmission gear rotatably connected to said housing, disposed in said receiving space and meshing with said start gear, and a final gear coupled co-rotatably and concentrically to said flywheel, disposed in said receiving space, and meshing with said transmission gear, a rotational speed of said final gear being greater than that of said start gear;

wherein said housing has a first shell body and a second shell body which are fixedly connected with each other and define said receiving space, and said first shell body and said second shell body are co-rotatable relative to said shaft at the same time;

wherein said ring-shaped flywheel is freely rotatable relative to said shaft, and said ring-shaped flywheel is rotatable in a rotational speed different from a rotational speed of said shaft.

wherein said ring-shaped flywheel is freely rotatable relative to said first shell body and said second shell body at the same time.

2. The hand tool as claimed in claim 1, wherein:

said gear mechanism includes a plurality of said transmission gears;

each of said transmission gears having a first gear portion that meshes with said start gear, and a second gear portion that meshes with said final gear; and said start gear is surrounded by said first gear portions of said transmission gears.

3. The hand tool as claimed in claim 2, wherein:

said ring-shaped flywheel has a central hole for extension of said shaft therethrough;

said final gear surrounds said shaft and is disposed adjacent to said central hole; and said final gear is surrounded by said second gear portions of said transmission gears.

4. The hand tool as claimed in claim 3, wherein said first shell body has a first ring wall, said second shell body has a second ring wall opposite to said first ring wall along the axis, said housing further includes a side wall interconnecting outer peripheries of said first and second ring walls and cooperating with said first and second ring walls to define said receiving space, and said transmission gears are rotatably mounted on said second ring wall.

5. The hand tool as claimed in claim 1, wherein said first and second ends of said shaft are disposed respectively at opposite outer sides of said housing.

6. The hand tool as claimed in claim 5, further comprising a handle and a tool head that are respectively and removably connected to said first and second ends of said shaft.

7. The hand tool as claimed in claim 5, wherein said first and second ends of said shaft are respectively configured as a handle and a tool head.

8. The hand tool as claimed in claim 1, wherein said shaft includes an axially through hole.

9. The hand tool as claimed in claim 8, wherein said axially through hole is polygonal.

10. The hand tool as claimed in claim 8, wherein said axially through hole is a straight hexagonal hole.

11. The hand tool as claimed in claim 1, wherein said shaft is integrally formed of one piece.

12. The hand tool as claimed in claim 1, wherein said ring-shaped flywheel is a solid flat ring plate.

13. The hand tool as claimed in claim 1, wherein at least one of said first end portion and said second end portion includes a toothed mechanism circumferentially arranged and located out of said housing.

14. The hand tool as claimed in claim 1, wherein there is at least one gap between said final gear and said shaft.

15. The hand tool as claimed in claim 14, wherein said ring-shaped flywheel includes a toothed hole, and said final gear is meshed within said toothed hole and rotatably surrounds said shaft.

16. The hand tool as claimed in claim 15, wherein at least one of said final gear and said shaft includes at least one contact portion radially projecting therefrom, and said at least one contact portion spaces said final gear and said shaft.

* * * * *